US008960646B2

(12) United States Patent
Crawford

(10) Patent No.: US 8,960,646 B2
(45) Date of Patent: Feb. 24, 2015

(54) APPARATUS AND METHOD FOR USE IN HANDLING A LOAD

(75) Inventor: Alexander Charles Crawford, Newport-On-Tay (GB)

(73) Assignee: Deep Tek IP Limited, Newport-on-Tay (GB)

( * ) Notice: Subject to any disclaimer, the term of this patent is extended or adjusted under 35 U.S.C. 154(b) by 493 days.

(21) Appl. No.: 13/388,349

(22) PCT Filed: Aug. 2, 2010

(86) PCT No.: PCT/GB2010/051268

§ 371 (c)(1),
(2), (4) Date: Feb. 1, 2012

(87) PCT Pub. No.: WO2011/015856

PCT Pub. Date: Feb. 10, 2011

(65) Prior Publication Data

US 2012/0132875 A1 May 31, 2012

(30) Foreign Application Priority Data

Aug. 7, 2009 (GB) ..... 0913819.9

(51) Int. Cl.
*B66D 1/00* (2006.01)
*B66C 13/14* (2006.01)
(Continued)

(52) U.S. Cl.
CPC . *B66C 13/14* (2013.01); *B66D 1/30* (2013.01); *E21B 19/22* (2013.01)
USPC ..... 254/266; 242/439.2; 242/439.6

(58) Field of Classification Search
USPC ..... 254/266; 242/439.2, 439.6, 441.2
See application file for complete search history.

(56) References Cited

U.S. PATENT DOCUMENTS 3,029,586 A * 4/1962 Walsh et al. ..... 57/3
4,019,715 A * 4/1977 Vugrek ..... 254/134.3 R
5,520,135 A * 5/1996 Rolland et al. ..... 114/254
(Continued)

FOREIGN PATENT DOCUMENTS

WO WO-00/56654 A1 9/2000
WO WO-2004/035455 A2 4/2004
WO WO-2008/040976 A1 4/2008

OTHER PUBLICATIONS

Sheppard, Bruce, "International Search Report" for PCT/GB2010/051268, as mailed Dec. 2, 2010, 5 pages.

*Primary Examiner* — Emmanuel M Marcelo
(74) *Attorney, Agent, or Firm* — Winstead PC

(57) ABSTRACT

Apparatus and method for use in handling a load, the apparatus comprising a load bearing elongate member (2) and a load bearing mechanism for paying out and recovering the load bearing elongate member; at least one service umbilical (9, 10) and a mechanism (12) for paying out and recovering the service umbilical; at least one securing member, and a wrapping device (15, 16) for rotating the securing member around the load bearing elongate member and the service umbilical as they are being paid out and to unwrap the or each securing member from the load bearing elongate member and the service umbilical as they are recovered. The rotation of the securing member by the wrapping device is powered by power supplied via a power conduit (25) in the form of an elongate flexible conduit wrapped onto a power conduit drum that has a central axial bore arranged concentrically with the load bearing elongate member during handling of the load. The power conduit drum has a cut out (28*c*) to allow passage of the elongate member into the central bore of the drum.

37 Claims, 9 Drawing Sheets

(51) Int. Cl.
*B66D 1/30* (2006.01)
*E21B 19/22* (2006.01)

(56) References Cited

U.S. PATENT DOCUMENTS 5,727,373 A * 3/1998 Appleford et al. ..... 57/1 UN
5,979,288 A * 11/1999 Gallagher et al. ..... 87/36
6,032,448 A * 3/2000 Baker et al. ..... 57/10
6,712,336 B1 * 3/2004 Crawford ..... 254/266
6,752,384 B2 * 6/2004 Matheson ..... 254/266
7,201,365 B2 * 4/2007 Crawford ..... 254/284
8,001,756 B2 * 8/2011 Crawford ..... 57/3
2001/0042857 A1 * 11/2001 Crawford ..... 254/266
2005/0191165 A1 * 9/2005 Willis et al. ..... 414/803

* cited by examiner

APPARATUS AND METHOD FOR USE IN HANDLING A LOAD

This invention relates to apparatus for use in handling a load supported by an elongate member such as a load bearing line. The invention is particularly useful in raising and lowering a load, towing, and also handling service cables, hoses or other elongate lines that are connected between a suspended load and a winch. The invention is also useful for deploying and handling other elongate members such as tube and pipes. The invention is particularly, but not exclusively, applicable to the subsea deployment of very heavy or bulky loads on coiled tubing and the deployment of signal and power cables to subsea locations such as wells or the sea bed. The invention is applicable to an emergency subsea response system for remedial action on subsea structures, such as recovering oil from pipes, well or subsea structures.

Delivering elongate members like cables, pipes and tubes over large distances between the sea surface and underwater equipment often involves the provision of a specific bundle of cable(s) and/or hose(s) dedicated to each application. For example, pneumatic hoses, hydraulic methanol, detergent or other fluid hoses, power, signal and control conduits may be needed to convey power and signals to the tools at the seabed or in the well, and/or to convey data or signals from the tool to the surface, as well as structural members like coiled tubing and drill pipe strings, which are used to support the weight of the equipment.

According to an aspect of the present invention there is provided apparatus for use in handling a load, the apparatus comprising;

a load bearing elongate member and a load bearing mechanism for paying out and recovering the load bearing elongate member;

at least one service umbilical and a service umbilical mechanism for paying out and recovering the or each service umbilical;

at least one securing member to wrap around the load bearing elongate member and each service umbilical, and a wrapping device for rotating the or each securing member around the load bearing elongate member and the service umbilical as they are being paid out and to unwrap the or each securing member from the load bearing elongate member and the service umbilical as they are recovered;

wherein the rotation of the securing member by the wrapping device around the load bearing elongate member and each service umbilical is powered by power supplied via a power conduit, and wherein the power conduit is in the form of an elongate flexible conduit that is wrapped onto a power conduit drum that has a central axial bore that is adapted to be arranged generally concentrically with the load bearing elongate member during handling of the load.

The invention also provides a method for handling a load, the method comprising;

supporting the load from a load bearing elongate member on a load bearing mechanism for paying out and recovering the load bearing elongate member;

providing at least one service umbilical and an service umbilical load bearing mechanism for paying out and recovering the or each service umbilical and paying out and recovering the service umbilical with the load bearing elongate member;

wrapping at least one securing member around the load bearing elongate member and each service umbilical as they are being paid out and unwrapping the or each securing member from the load bearing elongate member and the or each service umbilical as they are recovered;

powering the rotation of the securing member by the wrapping device around the load bearing elongate member and each service umbilical by power supplied via an elongate flexible conduit that is wrapped onto a power conduit drum having a central axial bore that is adapted to be arranged generally concentrically with the load bearing elongate member during handling of the load.

Optionally the load bearing mechanism for paying out and recovering the members can be a winch mechanism.

Typically the service umbilical can be arranged and adapted to deliver fluids to a subsea location, but in certain embodiments could also be arranged and adapted to recover fluids from the subsea location.

Optionally one or more signal conduits can be provided, either arranged as one of the service umbilicals, and wrapped by the service umbilical mechanism, or optionally the or each signal conduit could be arranged in a similar manner to the power conduit, optionally on the same drum as the power conduit. In certain embodiments, signal conduits can be combined in the same cable or linear bundle as the power conduit, or can be provided on a different cable or linear bundle, but optionally wrapped onto the same drum as the power conduit. In some embodiments, signal conduits can be provided in a separate cable wrapped onto a separate drum from the power conduit, which can optionally be stacked on the same axis as the power conduit drum, so that it rotates with the power conduit drum and typically has a discontinuity that is typically aligned with the discontinuity on the power conduit drum.

According to these embodiments, the power conduit can optionally carry signals to or from the motors, as well as power. The signals can be used to control the wrapping motor speed, tension, angle of wrap etc. and can allow also gather data from the motors or other parts of the system to provide feedback e.g. from the wrapping motors to a control system. Providing the signal cables on a drum with a central axis in the same manner (and optionally on the same drum) as the power cable allows the service umbilicals to provide power and signals etc to the load, e.g. a pump on the seabed.

The signal conduit can optionally deliver signals to and from the load, which can optionally be a piece of intervention equipment capable of being controlled from the surface, for example to speed up a pump that is provided on the intervention equipment, or could also be capable of reporting data (e.g. pressure, temperature etc) gathered by the intervention equipment at a subsea location where the intervention equipment has been deployed, and optionally transmitted back to surface via the signal conduit.

Typically the power conduit drum has a discontinuity (typically in the form of a cutaway section of the radius of the drum) that allows passage of the load bearing member (and optionally the service umbilical) through the discontinuity and into the central axial bore of the drum so that the drum is generally C-shaped, and can be moved over the load bearing member (and optionally the service umbilical) without disconnection of the load bearing member from the load. The cutaway section can be wedge shaped, and can extend the axial length of the drum, so that the load bearing member can move from outside the drum, through the radial passage, and into the central axial bore. The discontinuity allows the winder system to be used with large or heavy equipment on the end of the elongate member without passing the equipment (or connectors to the equipment) through any part of the winder, particularly through the axial bore of a drum.

Optionally, the apparatus can include a mechanism for holding the securing member, typically in the form of a securing member drum that can optionally rotate with the power conduit drum. The securing member is typically wound around the wrapped bundle of the elongate member and the service umbilical to hold them together. The securing member can be planar, in the form of a strip, tape or ribbon, or can have a circular cross-section, for example in the form of a rope. In some embodiments, the securing member is resilient and is advantageously applied to the load bearing member in tension. In some cases, the securing member can be adapted to change its conformation when applied to the load bearing member. For example, in some cases, the securing member can be a resilient rope with a circular cross section and when applied to the bundle of the load bearing elongate member and the service umbilical it can alter its cross sectional conformation to adopt a generally flat or planar conformation, e.g. when under tension. The power conduit drum is typically rotationally fixed to the securing member drums.

The power conduit typically has one end terminal adapted to connect, and thereby deliver power, to a motor for driving the rotation of the wrapping device for the securing member. Typically the wrapping device, the power conduit drum, and the securing member drum are built onto a rotating chassis that rotationally connects these components together. Typically the chassis can rotate with respect to the elongate member during operations. Optionally the chassis comprises a track that incorporates a radial discontinuity that permits a portion of the track to be removed or moved to allow passage of the elongate member through the discontinuity. Typically the chassis or track has a central axial bore, and the discontinuity permits passage of the elongate member through the radial walls of the track into alignment with the central axial bore. The radial discontinuity of the chassis is typically aligned with the discontinuity of the power conduit drum. Optionally the discontinuities can be filled by plugging sections of the drum or the rails, which are removed to allow passage of the elongate member through the discontinuity, and replaced thereafter to surround the elongate member.

Embodiments of the invention allow service umbilical(s) to be automatically lowered and their weight supported when an elongate strength member such as an elongate member is lowered to the seabed. The service umbilicals are typically automatically recovered as the elongate member is recovered. The securing member(s) typically transfers most of the weight of the service umbilicals to the elongate member.

The service umbilicals are typically connected to the load and the elongate member(s) are typically lowered to allow the winder mechanism to be run across on rails, guides, tracked across, or swung in on a pivot or hinge in order that the elongate member is located near to a rotational axis for the securing members.

When the winder is moved across to surround the elongate member any slip rings or power/signal transfer systems are typically opened at one point to allow the mechanisms to clear the coiled tubing. The opening may be closed after the winding mechanism is moved or left open and the rotating mechanism is optionally designed to move over the gap. Alternatively the open section can have an insert to close off the gap in a stationary position in order that it locks against it when the winding mechanism is moved to envelop the elongate member.

The track and optionally the whole of the chassis can be mounted on rails that guide movement of the power conduit drum and the elongate member in relation to one another, so that the elongate member can move (e.g. slide on the rails in a straight line or swing on an axis) into and out of the central axial bore of the power conduit drum. The drum typically moves relative to the stationary elongate member and the stationary rails.

Optionally the chassis comprises the power conduit drum, the securing member and any drums for holding and paying out the securing member, and optionally guide tracks for guiding the rotational movement of the power conduit drum. The whole of the chassis can typically translate along the rails in a direction that is perpendicular to the central axis of the elongate member whereby the elongate member is moved into the central axial bore of the power conduit drum. Typically the discontinuities are aligned so as to receive and allow passage of the elongate member through the radial cutaway sections of the drum and the track, before initiating relative translational movement of the chassis and the elongate member. In the event that the discontinuities are closed off by plugging sections these are optionally replaced before rotational movement of the drum or chassis commences.

The power conduit is typically wound onto the power conduit drum after the elongate member is moved into alignment with the central axial bore of the power conduit drum. At this point, the power conduit is typically connected to the drum at an anchor point on the barrel of the drum between the two flanges, and the winding of the power conduit around the barrel of the drum typically closes off the discontinuity in the drum.

The power conduit is typically fed onto the power conduit drum from a feeder drum that is spaced away from the power conduit drum on the chassis, but is typically aligned therewith in the same plane, so that the power conduit can be fed from the feeder drum and onto the power conduit drum on the chassis with minimal distortion of the power conduit. However, the power conduit drum and the feeder drum could be in two different planes, which can be (but need not be) parallel. The power conduit can optionally be tensioned while being fed onto the power conduit drum. The feeder drum can optionally have rotational couplers for upstream connection to the power supply, such as slip rings. Since the slip rings are provided on the feeder drum and not on the power conduit drum or tape drums, and since the feeder drum does not need to have an axial passage to accommodate the elongate member, the slip rings or other rotational couplers can be simple and inexpensive slip rings of conventional design. Typically the power conduit is wrapped onto the power conduit drum from the feeder drum after the elongate member (and optionally the service umbilical) is in place in the central axial bore of the power conduit drum, and typically the power conduit is unwrapped from the power conduit drum (e.g. being recovered onto the feeder drum) as the elongate member (and optionally the service umbilical) is paid out. The feeder drum can optionally have a tensioning motor to apply back tension to the power conduit as it is being wrapped onto the power conduit drum. It may optionally also have a level wind mechanism for guiding the power conductor off and on the drums.

The length of power conduit wound onto the power conduit drum is less than the length of securing tape needed to wind around the bundle of elongate member and service umbilical, as the power conduit only needs to wrap around the power conduit drum in a single plane and does not need to extend axially with the elongate member. A sufficient length of power conduit is typically wound on the power conduit drum from the feeder drum once the elongate member is in place in alignment with the central axis of the drum. Optionally, the power conduit can be wound from the feeder drum onto the power conduit drum before the elongate member is paid out, but in some embodiments, this is not necessary, and the power conductor can be wound on as soon as the mechanism starts to rotate around the elongate member.

The term "elongate member" is used herein to denote a flexible elongate member typically having a central bore that can be used for conveying smaller diameter conduits within the central bore. Optionally the elongate member can be an electrical cable, a fibre optic cable, or a pneumatic or hydraulic hose. Flat or tubular hoses can be provided to convey methanol, detergent or other fluids from the surface to the wellhead, or production or other wellbore fluids from the well to the surface. However, in typical embodiments of the invention, the elongate member is a strength member comprising a structural member such as tubing like coiled tubing and pipe such as drill pipe strings. The elongate member could be formed of steel or other metal tubing, or can be synthetic pipe. Optionally the elongate member can be coiled or straight and can be used as a riser to allow other lines to be passed down the centre into the well. In certain embodiments, the elongate member can omit the central bore and can be used merely for support. For example, the elongate member can optionally be a rope such as a fibre, wire or other rope. Conduits conveying fluids or other smaller diameter conduits can be provided as service umbilicals, wrapped with the elongate member, and can be arranged to convey fluids in different directions between the surface and the subsea location.

During deployment, the umbilical, the elongate member, service umbilical and (optionally) the securing member are typically initially separate but are wound or wrapped together using the wrapping device, and travel in train as a single wrapped bundle of lines. The elongate member is typically continuously paid out by the winch, until the full desired length is reached, after which it can be recovered by operating the winch in reverse, and the wrapping devices typically separate and recover the various lines at the surface.

The service umbilical can comprise power cables, signal cables, communication cables or optics and tubes or other conduits carrying fluids or other substances.

In one embodiment the service umbilical(s) can be arranged parallel to the elongate member, and can be paid out at the same speed and for the same distance, but in other embodiments the service umbilical(s) can be paid out at a faster rate than the elongate member, so that more of the service umbilical(s) are paid out than the elongate member. The elongate member is typically paid out on a straight path, and typically bears the load of the equipment being handled and so is tensioned by that load.

The or each service umbilical can optionally be moved in a cyclic pattern in relation to the elongate member, and can be secured in place in the cyclic pattern by the wrapping of the securing member around the elongate member and the service umbilical.

In one embodiment, the wrapping device deploying the service umbilical(s) moves from side to side cyclically with respect to the elongate member, so that the service umbilical(s) adopt a winding path (e.g. a sigmoidal path) along the elongate member. This typically creates some play in the service umbilical, which allows the stretching of the elongate member, causing the service umbilicals to straighten out on the elongate member and move toward being parallel thereto, without damaging or stretching the service umbilicals. The path can be regular or irregular. Typically the path does not wind around the elongate member.

Wrapping the service umbilical and the elongate member together means that the elongate member can provide the mechanical support for the bundle during the transition between the surface and the sea bed, and the service umbilical can be designed without a requirement to withstand high forces. This is especially useful if the elongate member is put under tension during the transition between the surface and the sea bed, since it can then be set to travel in a relatively straight line (or at least with predictable and minor deviations from a straight line), and can be easily engineered to withstand the forces that tend to make it deviate from that predicted course. This enables the service umbilical to be delivered with high accuracy and with confidence that any deviations from the straight path defined by the tensioned elongate member will be greatly reduced, or confined within acceptable limits, and that any such deviations will be resisted not by the service umbilical (which might be a fragile cable such as a fibre optic cable) but by the elongate member which can be e.g. a length of coil tubing that is specifically adapted to withstand lateral and axial forces (for example tides and currents) tending to deviate it from the straight path. Of course, the wrapped bundle can be purposely tensioned between different intermediate points between the surface and sea bed to adopt a path that is not straight, but is for example, z-shaped or some other shape, but in each case, the lateral deviation of the elongate member (and thus of the rest of the wrapped bundle) can be resisted by the tension in the elongate member, and the forces exerted on the bundle by any such deviation can be borne by the elongate member and not by more fragile elements of the bundle. A further advantage of the present invention is that the angle of delivery of the service umbilical at the sea bed can be accurately maintained, as the elongate member can be tensioned to provide the whole wrapped bundle with the same angle of incidence with respect to the wellhead or other structure located at the sea bed.

The speed of deployment can be determined by the speed of one or each of the wrapping devices. One of the winch or wrapping devices can be driven and the other can idle or can be used to set the tension in the elongate member. All or some of the wrapping devices can be self tensioning allowing them to pay in or out as the elongate member is hoisted or lowered.

The device can be deployed on a rig, or on a vessel, and some embodiments (particularly those deployed on vessels) can have heave compensator mechanisms optionally incorporated into the or each winch drum.

More than one securing member can be provided. Securing members can overlap one another in the wrapped bundle.

The securing member comprise a non elongating material or optionally a resilient or elastic material such as a hollow braided rope that may optionally be coated to modify (e.g. increase) the coefficient of friction. It may also be modified with surface hairs to modify (e.g. reduce) the water drag on the pipes cables etc in the water column. The securing member can be flat or in the form of a hollow rope that flattens when in contact with an object.

The securing member can optionally be paid out under gentle or no tension, from a feeder device, which can in certain embodiments comprise a sheave device arranged to feed the securing member into the apparatus along or parallel to a central axis.

In some embodiments, the securing member holding drum may be rotatably mounted on a structural member so that it is moved in a circular path around the axis of the elongate member as it being paid out or recovered. The axis of the securing member drum in such embodiments can be vertical so that it is parallel to the axis of the elongate member, or horizontal, so that it is perpendicular to the axis of the elongate member.

The drums are typically powered to drive the securing member for recovery and can be self tensioning in order that they pay out and in as the elongate member is raised or lowered. They can optionally have a levelwind mechanism to feed the tape evenly on and off the drum. They may be driven mechanically, electrically or hydraulically or by any other power source. They may be mounted with their axes arranged horizontally or vertically.

In some embodiments the securing member can be stored on and deployed from a securing member drum being arranged for rotation about its own axis that coincides with the central axis of the elongate member. The securing member may be guided by sheaves or pulleys from the drum, which can optionally be mounted on spooling arms. Instead of rotating on its axis, the drum may be static and may have a winding device rotating around it to pay out the securing member. The drum may have a central aperture through which the securing member passes.

In other embodiments, the securing member drum may be rotatably mounted on a different axis so that its axis is not co-incident with the axis of the elongate member, and so that it is moved in a circular path around the axis of the elongate member as the securing member is being paid out or recovered. Sheaves and/or pulleys may guide the securing member as it is being paid out or recovered. The axis of the drum in such embodiments can be vertical so that it is parallel to the axis of the support line, or horizontal, so that it is perpendicular to the axis of the support line. In embodiments with more than one securing member, the securing members are optionally stored on drums that are set on axes on opposite sides of the elongate member and the drum axes are arranged parallel to one another, and perpendicular to the axis of the elongate member.

Optionally, the securing member leaves the securing member drum and any associated sheaves radially outward of the elongate member to wind the securing member around the outside of both the elongate member and the service umbilical.

Optionally, the securing member has elastic properties. Typically, the securing member can be made of neoprene with a nylon or other reinforcing strip or sheath. The securing member can have a reinforcing strip woven into it to limit the maximum extension of the member, or can be sheathed in e.g. nylon. The securing member may be planar, and may incorporate an adhesive to hold the securing member to the elongate member.

The elongate member and the service umbilical(s) can be stored on respective drums, each typically having a respective winch mechanism. The drums can be stored on the deck of the vessel that is deploying the apparatus, or can be stored on the apparatus. In some embodiments, some of the drums can be stored on the apparatus (e.g. on a frame of the apparatus) and some of the drums can be stored on a deck. Optionally, each of the winch mechanisms has a respective driving motor. Optionally, the apparatus also includes a guide means for guiding the load-bearing elongate member. Typically, the guide means comprises at least one roller or sheave. Optionally, more than one roller is provided. Optionally, four rollers are provided around the circumference of the line forming a roller cage which encloses the load-bearing elongate member.

The winder system can optionally include power transducers such as slip rings for transmitting power through rotational joints such as bearing axles for drums. Conventional slip rings are known and available to transfer electrical, optical and hydraulic power and signals.

Umbilical(s) may also be wrapped around a drum on the rotating unit and led to another self tensioning drum unit that contains slip rings.

Large items such as intervention packages or well control packages or other large equipment can thus be lowered or recovered while supported by the elongate member.

The service umbilical(s) typically run over sheaves attached to the winding mechanism to allow them to be fed alongside and parallel to the elongate member. The umbilical winches can optionally be positioned clear of the winding mechanism with the umbilical(s) typically running over sheaves to reach the winding mechanism. The elongate member typically supports the weight of the cables, tubes etc that are wrapped around the elongate member.

According to a further aspect of the present invention there is provided apparatus for use in handling a load, the apparatus comprising;

- a load bearing elongate member and a load bearing mechanism for paying out and recovering the load bearing elongate member;
- at least one service umbilical and an service umbilical mechanism for paying out and recovering the or each service umbilical along with the load bearing elongate member;
- at least one securing member to wrap around the load bearing elongate member and the or each service umbilical, and a wrapping device for rotating the or each securing member around the load bearing elongate member and the service umbilical as they are being paid out and to unwrap the or each securing member from the load bearing elongate member and the service umbilical as they are recovered;
- wherein the apparatus comprises at least one storage drum adapted to hold at least one of the service umbilical, the securing device and a power conduit for powering rotation of a part of the apparatus, the storage drum having a central axial bore and at least one radially extending flange, and wherein at least one of the storage drums is provided with a discontinuity allowing passage of the elongate member through the discontinuity and into the central axial bore of the storage drum.

Optionally the load bearing mechanism for paying out and recovering the members can be a winch mechanism.

Examples of apparatus and a method for use in handling a load in accordance with the invention will now be described with reference to the drawings, in which:—

Figure 1:
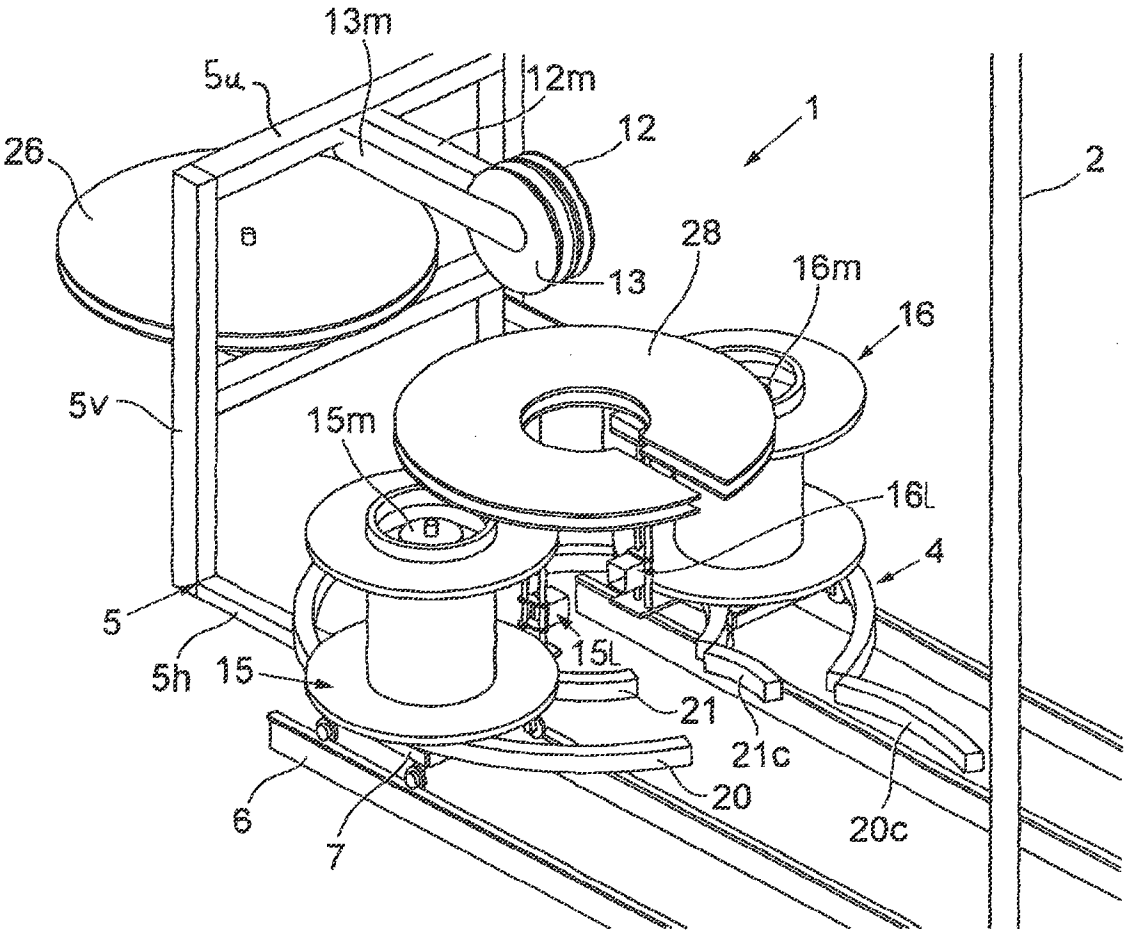
FIG. 1 is a schematic perspective view illustrating a first example of apparatus for handling a load in a first configuration before use.
Figure 2:
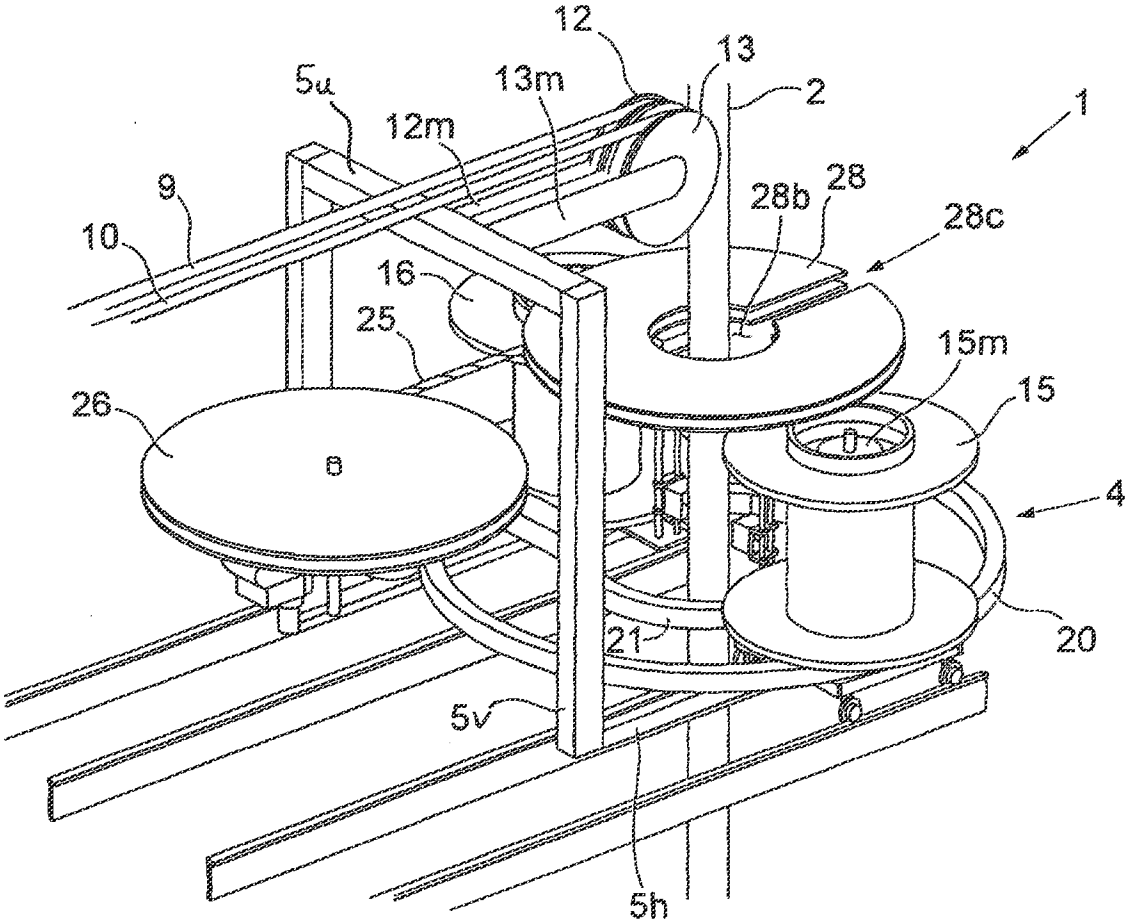
FIG. 2 is a perspective view of the FIG. 1 apparatus in a second configuration where the apparatus is in use.

Referring to FIG. 1, a winder system 1 for use with an elongate member in the form of coiled tubing 2 is disclosed, for use on a rig or ideally on a coiled tubing support vessel without a requirement for a rig. In coiled tubing operations, a package of subsea equipment (e.g. a wellhead lubricator) is connected to surface by means of a length of coiled tubing 2, which supports the weight of the package. Typically the packages are extremely heavy and bulky, as are sometimes the connectors for such packages. The package typically requires power and data transmission between the surface and the package. For this purpose, a pair of service umbilicals 9, 10 (see FIG. 2) supply power to the package and collect and/or deliver data to it from the surface. The service umbilicals are paid out over sheaves 12, 13 so that the service umbilicals extend generally parallel to the coiled tubing 2. The service umbilicals can be in the form of fibre optic cables, power conduits (hydraulic, electrical or other), data conduits and the like. Several conduits can be provided in each umbilical.

The coiled tubing 2 typically extends from a storage drum (not shown, but typically located on the deck of the vessel) over a sheave (not shown) to connect ultimately at its lower end to a package of subsea equipment, which may be a heavy and bulky item such as a wellhead, or a component of a wellhead, such as a BOP, a lubricator, a pump, e.g. a variable speed pump, or any kind of intervention equipment, including a combination of these components. The equipment may have instruments, cameras, sonar devices, lights etc mounted on it all powered through the umbilicals. In this example the package is a wellhead lubricator 3.

The coiled tubing 2 is only one form of elongate member that is suitable for use with the apparatus of the present invention, and in other embodiments, the elongate member may be any suitable form of load bearing elongate member such as flexible steel wire rope or synthetic fibre rope, for example of "Spectra". Alternatively the load bearing mechanism can be of "Kevlar" or similar. The elongate member may be a conduit, and may in one embodiment comprise a riser with a central bore that can receive and convey fluids or other conduits therein, which could in turn house separate cores of wire or cable to convey power or signals in different directions, fibre optic lines and/or hydraulic or pneumatic conduits etc to convey fluids. The coiled tubing 2 typically comes off the end of a sheave (which may be on the apparatus or may be on a derrick or other lifting structure above the winding system, and is typically aligned with the central axis of the power conduit drum 28.

The winder system 1 has a generally L-shaped frame 5 with a horizontal portion 5*h* and a vertical portion 5*v* which extend in perpendicular planes to one another. The vertical portion carries respective sheaves 12, 13 for the service umbilicals 9, 10 on sheave arms 12*m*, 13*m* that space the sheaves 12, 13 away from the plane of the vertical portion 5*v*. The service umbilicals 9, 10 being deployed leave the sheaves tangentially on an axis that is close to and generally parallel to the axis of the coiled tubing 2 (see FIG. 2).

The horizontal portion 5*h* of the frame 5 carries a rotating frame 4, which is mounted on carriages (not shown) upon which it can rotate around a central axis in relation the frame 5. The carriages supporting the rotating frame are optionally fixed to the horizontal portion 5*h* of the frame 5. The rotating frame 4 comprises a pair of concentric rings comprising an outer ring 20 and an inner ring 21, which support a pair of securing member drums 15 and 16, each holding a length of tape or other securing member suitable for winding around the deployed coiled tubing 2 and the service umbilicals 9, 10 to hold them together during deployment. Each drum 15, 16 has a flange at each axial end of a central barrel to contain the securing member. The drums 15, 16 are mounted on axles enabling them to rotate relative to the rotating frame 4. The axles of the drums 15, 16 are fixed to the frame 4, so that the drums 15, 16 rotate with the frame around the central axis of the frame 4, but allowing each drum 15, 16 to rotate on its axis relative to the rings 20, 21 under the power of a respective hub motor 15*m*, 16*m* that is typically located in the central axial bore of each drum.

The rings 20, 21 on the frame 4 each have a cutaway portion 20*c* and 21*c*, which can optionally be hingedly connected at one end to the rings 20, 21, or can be completely removable therefrom. The cutaway portions 20*c*, 21*c* can be moved or removed from the circumference of the rings to create a passageway from the outside of the rings through the circumference and into the central axial bore of the rings 20, 21. The cutaway portions are typically radially aligned with one another and are typically fixed in position with respect to the frame 5.

The securing member drums 15, 16 can each have a respective levelwind device 15l, 16l that guides the line of securing member (e.g. tape etc) as it moves off the drums 15, 16. The tape etc passes through the levelwind device on the drum, and the levelwind device typically travels axially with respect to the drum to guide the tape etc off or onto the barrel of the drum.

The axial rotation of the drums 15, 16 relative to the rings 20, 21 is powered by the motors 15*m*, 16*m*, and the power for the motors 15*m*, 16*m* is supplied to the winding system from an external source, such as the electrical (or hydraulic) power system of the ship or other vessel on which the winder system is deployed. Power for the motors 15*m*, 16*m* is therefore routed through a power conduit 25 reeled onto a feeder drum 26 that is coupled to the donor power supply on the ship or other vessel by means of a basic design of rotational power coupling such as a basic slip ring.

The horizontal portion 5*h* of the frame 5 also carries a power conduit drum 28. The power conduit drum 28 and the feeder drum 26 are adapted to rotate together to wind power conduit off the feeder drum and onto the power conduit drum, and vice versa.

The power conduit drum 28 has a discontinuity in the form of a cutaway section 28*c* extending radially through the barrel and flanges of the drum 28. The channel 28*c* connects a central axial bore 28*b* of the drum with the exterior of the drum 28. The width of the channel 28*c* is sufficient to accommodate the width of the coiled tubing 2, thereby allowing the coiled tubing 2 to pass through the channel 28*c* from the exterior of the drum 28 into its central axial bore 28*b*.

The power conduit drum 28 is typically mounted on the rotating frame 4, and is typically rotationally fixed in relation to the drums 15 and 16, so that it cannot rotate in relation to the drums 15 and 16, and typically is also fixed in relation to the rings 20 and 21. The power conduit drum 28 typically supplies power to the hub motors 15*m* and 16*m* of the securing member drums 15 and 16, with which it is rotationally connected, and relative to which remains rotationally static. It is possible for the end terminus of the power conduit that is wound onto the power conduit drum 28 to be threaded through an aperture in the drum 28 (e.g. close to the barrel)

and connected directly to the hub motors, but it is conventional in the present embodiments for a connector cable or other conduit to extend from an electrical connector on the hub motor 15*m* to an electrical connector on the power conduit drum 28 for subsequent connection to the end terminus of the power conduit, which can typically be plugged into a mating connector on the barrel of the power conduit drum 28. The connector receiving the end terminal of the power conduit 25 is typically on one side of the channel 28*c*, typically on the side of the channel adjacent to the securing member drum 16.

In one embodiment, the channel 28*c* is typically fixed in position in relation to the cut away sections 20*c* and 21*c* on the rings 20 and 21, so that the discontinuities in the hub drum and the track are aligned with one another, permitting the coiled tubing 2 to pass therethrough without deviation of the coiled tubing 2.

Figure 5:
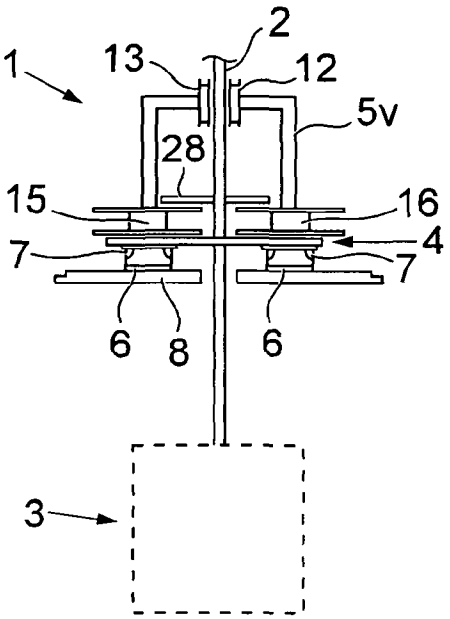
FIGS. 3 and 4 are side views and FIG. 5 is a front view showing schematically the progression of the FIG. 1 apparatus in simplified form from the before use to the in use configuration.
Figure 4:
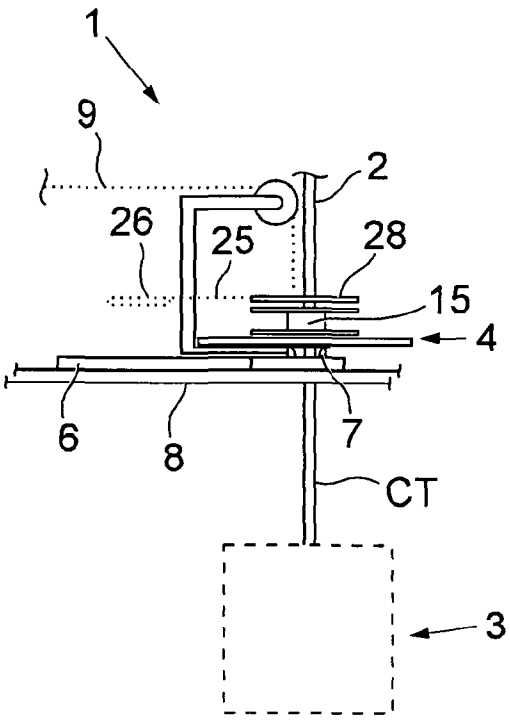
Figure 3:
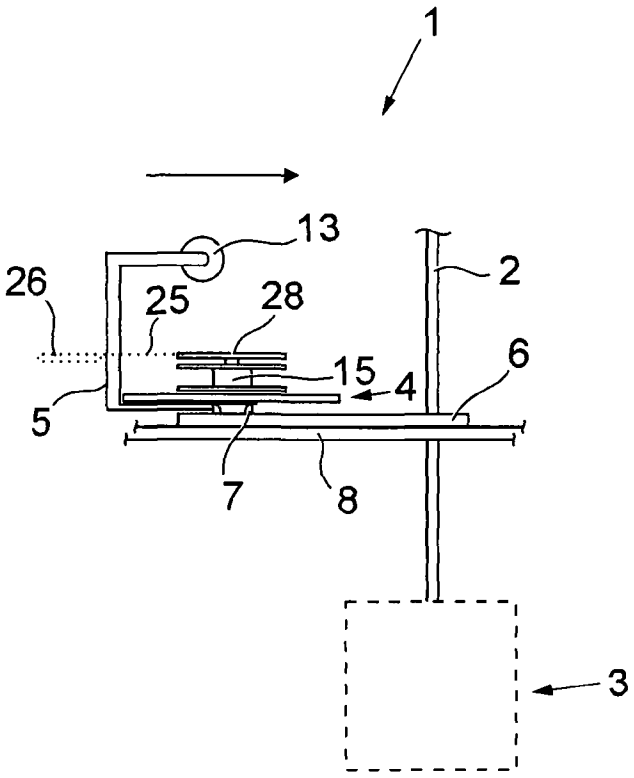

The L-shaped frame 5 is typically mounted on wheeled carriages 7 that run on rails 6 in order to translate the movement of the winding system 1 into and out of engagement with the coiled tubing 2. Referring now to FIGS. 3, 4 and 5, the rails 6 typically extend on either side of an aperture in a deck 8 which carries the winding system 1. The aperture in the deck 8 typically has the coiled tubing 2 passing through its central axis, supporting the lubricator 3 below the deck 8. This aperture can be a moonpool of a ship. In the initial configuration of the winding apparatus 1 is shown in FIG. 3, with the frame 5 being spaced apart from the coiled tubing 2. When the coiled tubing 2 is to be paid out along with the service umbilicals 9, 10, the winding system 1 is adjusted so that the discontinuities 20*c*, 21*c*, 28*c* are all aligned with one another in the position shown in FIG. 1, and the frame 5 is then rolled forward on the rails 6 by means of the wheeled carriages 7 until the rings 20, 21 and the power conduit drum 28 have been moved over the coiled tubing 2, which passes through the channels in the rings and the drum until the coiled tubing is co-axial with the rings 20, 21 and with the power conduit drum 28. At this point, the winding system 1 has adopted the configuration shown in FIGS. 4 and 5.

The securing cable drums 15, 16, having been preloaded with a sufficient length of securing cable to be paid out for the length of the trip, are then located on opposite sides of the axis of the coiled tubing 2. The service umbilicals 9, 10 extend over the sheaves 12, 13 on the frame 5, and are connected to the lubricator 3. Optionally this step can be carried out before movement of the frame 5. Because the sheaves 12, 13 are spaced from the horizontal portion 5*h* by means of the arms 12*m*, 13*m*, the service umbilicals 9, 10 leave the sheaves 12, 13 at a tangent that is axially parallel to and very close to the axis of the coiled tubing 2.

The service umbilicals can be stored on drums located on the deck 8, or located elsewhere on the vessel or platform, typically on winch drums driven by respective independent winch motors. In some embodiments, the two service umbilicals can be driven by a common winch motor.

Once the coiled tubing 2 is aligned with the central axial bore of the power conduit drum 28 and the rings 20, 21, the power conduit drum 28 is then driven in rotation (typically by rotating the whole assembly of the rotating frame 4, with associated securing member drums 15, 16, and the connected power conduit drum 28. The power conduit drum 28 is typically rotated clockwise and the rotation winds on to the drum 28 a power conduit 25 stored on the barrel of a feeder drum 26 that is rotationally mounted separately on the vertical portion 5V of the frame 5, or elsewhere on the deck or other part of the vessel. Typically, the feeder drum 26 has a hub motor permitting it to apply a back tension to the power conduit 25 being fed onto the power conduit drum 28. A sufficient number of turns of the power conduit are wound onto the power conduit drum 28 to enable sufficient rotations of the securing member drums around the axis of the coiled tubing 2 during deployment of the coiled tubing 2. In this way, power can be supplied from the power conduit 25 through the power conduit drum 28 in order to drive the motors 15*m*, 16*m* of the securing member hubs 15, 16 during deployment.

Figure 8:
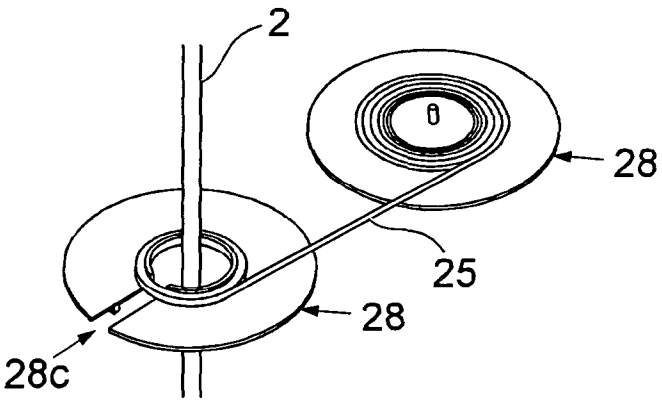
FIGS. 7 and 8 are similar perspective views of the FIG. 6 arrangement with the top flange of the drums removed for clarity.
Figure 7:
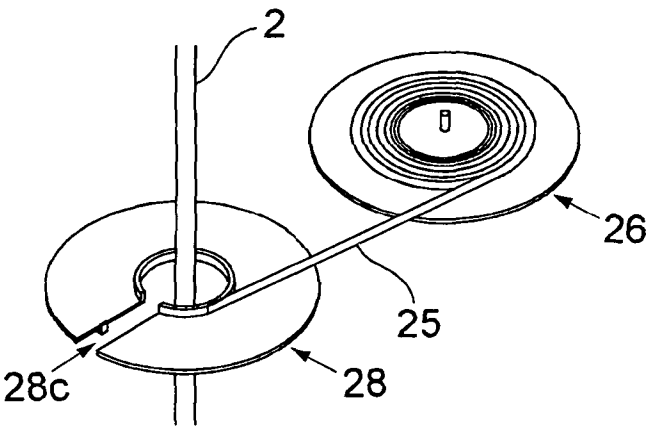
Figure 6:
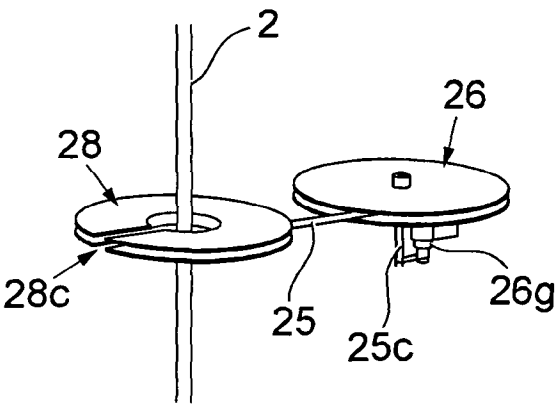
FIG. 6 is a perspective view of a power conduit drum and feeder drum for use in the FIG. 1 embodiment.

A more detailed view of the winding of the power conduit 25 can be seen in FIGS. 6, 7 and 8. As can be seen from a comparison of FIGS. 7 and 8, which show the drums 26, 28 with the top flanges thereof removed for the purposes of clarity, the power conduit 25 is initially stored principally on the feeder drum 26, and supplies power to its end terminal connected to a point on the barrel of the power conduit drum 28. The opposite end terminus of the power conduit 25 connects to a point (not shown) on the barrel of the feeder drum 26, which connects through a basic design of electrical slip ring or rotary coupling to a power conduit connector 25*c* leading to the ships main power supply. The power conduit drum 28 can optionally have the power conductors connected via connectors as the cable is typically routed around the back of the cutaway section.

A gear box 26*g* drives the rotation of the feeder drum 26. Referring now to FIGS. 7 and 8, simultaneous rotation of the drums 28 and 26 winds the power conduit 25 from the feeder drum 26 onto the power conduit drum 28, closing off the channel 28 in the process. This allows rotational coupling of the power conduit between the ship's main supply and the hub motors of the securing member drums without intricate and large scale slip rings. The slip ring or other rotary coupling on the feeder drum 26 can be quite basic in design, as it does not need a central aperture to accommodate the coiled tubing 2, nor any split or channel. The length of conduit 25 wound onto the power conduit drum 28 does not need to equal the length of securing member wound onto the securing member drums 15, 16, because the power conduit 25 is not being deployed axially, and is only being wound around the power conduit drum 28 in a single plane in contrast to the securing members which are helically wound around the axis of the coiled tubing and service umbilicals.

If the securing members wrap around the elongate member 2 every 10 meters the power conduit drum 28 only needs to rotate 300 times to pay out sufficient power conduit 25 to enable operations in up to 3000 meters of water. The power conduit drum 28 only needs to have the power conduit 25 attached after it is moved into position around the elongate member 2 so that no cable covers the cutaway section in the drum. As the elongate member 2 is paid out the umbilical(s) 9, 10 are paid out and the securing member drum(s) 15, 16 rotate around them to secure the umbilical(s) 9,10. As the elongate member 2 is recovered the securing tape is unwound and the umbilical(s) recovered.

Figure 9:
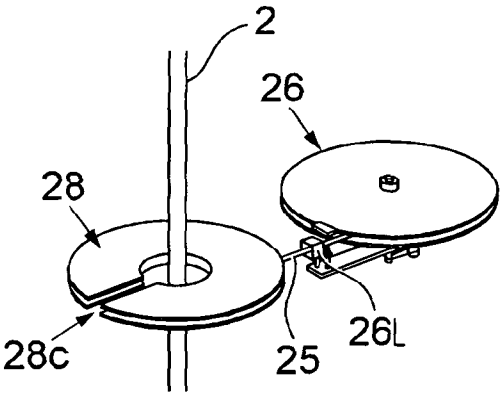
FIG. 9 is a perspective view of an alternative embodiment of power conduit drum and feeder drum.

The power conduit 25 can be a cable as shown in FIGS. 6-8, or can be a ribbon or tape as shown in FIG. 9 with a substantially flat profile, thereby reducing the required diameter and weight of the feeder and power conduit drums 26, 28. Optionally, the feeder drum 26 can have at least one levelwind device 26*l* to guide the wrapping of the power conduit 25 between the drums 26, 28, as shown in FIG. 9.

A sufficient length of power conduit 25 is typically wound onto the power conduit drum 28, and the securing members are then wound onto the securing member drums 15, 16 and can be attached to the coiled tubing 2 and the service umbilicals 9, 10, for example by tying them around the central axis thereof or connecting them to the lubricator 3, and the rotating assembly of the rings 20, 21 securing cable drums 15, 16 and power conduit drum 28 can be driven in rotation by motors mounted on the deck and meshing with gears on the inside or outside of one of the rings 20, while the securing member drums 15, 16 are driven in rotation relative to the rings 20 by the hub motors 15*m*, 16*m*. The torque of the hub motors 15*m*, 16*m* can be varied in order to apply or adjust the amount of back tension applied to the securing members as they are wound helically around the axis of the coiled tubing 2. It is not necessary to wind the power conduit onto the power conduit drum before deployment of the elongate member.

Figure 12:
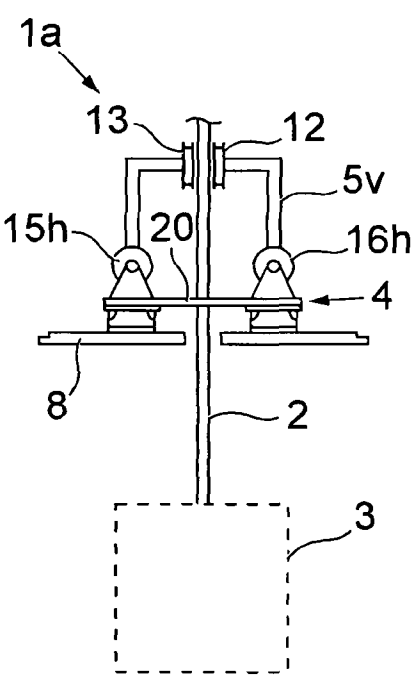
FIGS. 10 and 11 are side views and FIG. 12 is a front view showing schematically the progression of a second embodiment in simplified form from the before use to the in use configuration.
Figure 11:
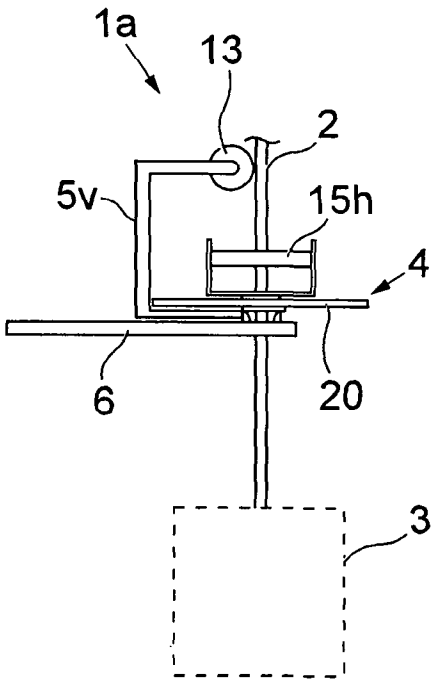
Figure 10:
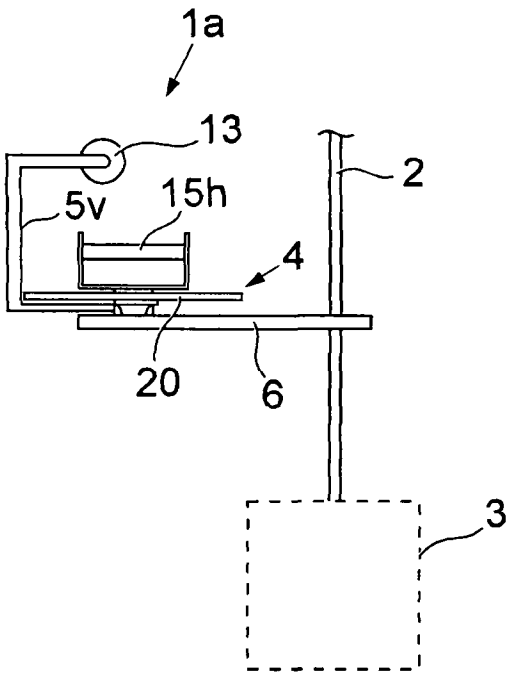
Figure 14:
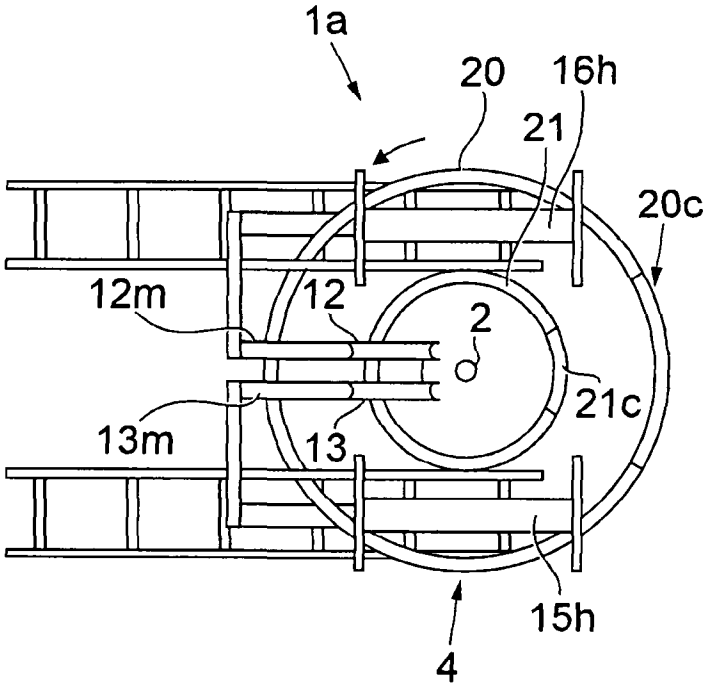
FIGS. 13 and 14 are sequential top views of the second embodiment corresponding to the configurations in FIGS. 10 and 11.
Figure 13:
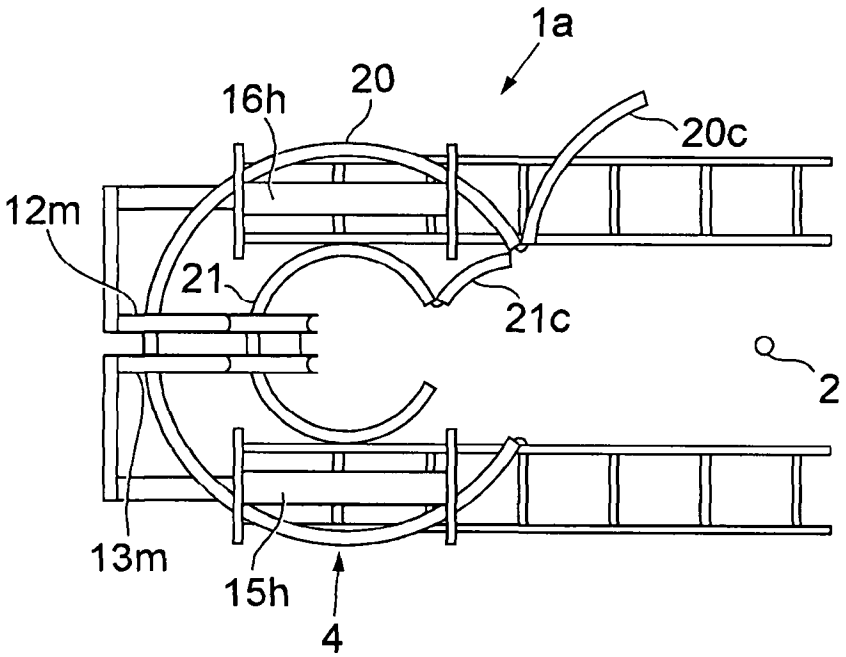

Modifications and improvements can be incorporated without departing from the scope of the invention. For example, in FIGS. 10, 11 and 12, an alternative embodiment of a winding mechanism 1*a* is shown having the same features as the winding mechanism 1, but instead of the drums 15, 16 being disposed with their axes in the vertical plane, the axes of drums 15*h*, 16*h* in the embodiment 1*a* are arranged in the horizontal plane, typically parallel to one another, and typically located on either side of the central axis of the coiled tubing 2, as shown in FIG. 12. As shown in FIGS. 13 and 14, the winding system 1*a* typically functions in the same manner as the winding system 1, with cutaway sections 20*c*, 21*c* being hingedly connected to the remainder of the rings and being fixed in alignment with one another for a combination of the coiled tubing 2 into the central axial bore of the rings 20, 21.

Figure 16:
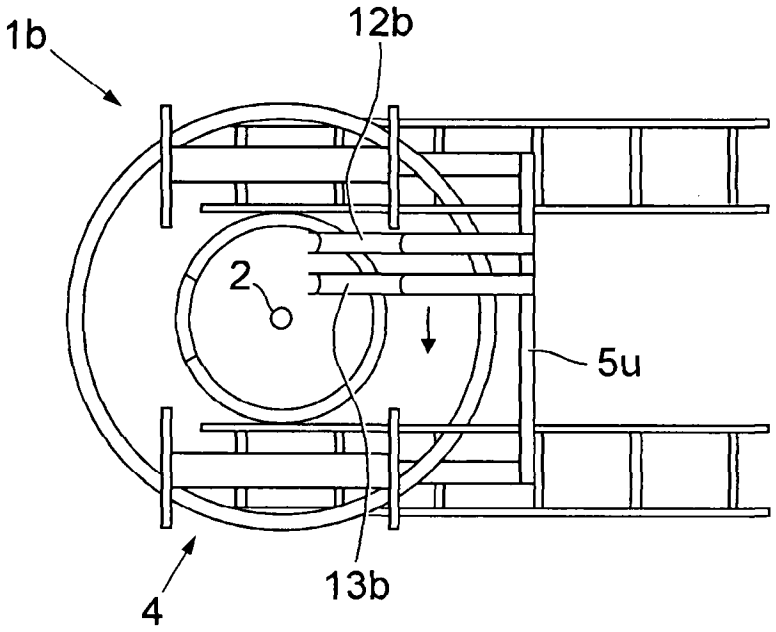
FIGS. 15 and 16 are top views of the second embodiment.
Figure 15:
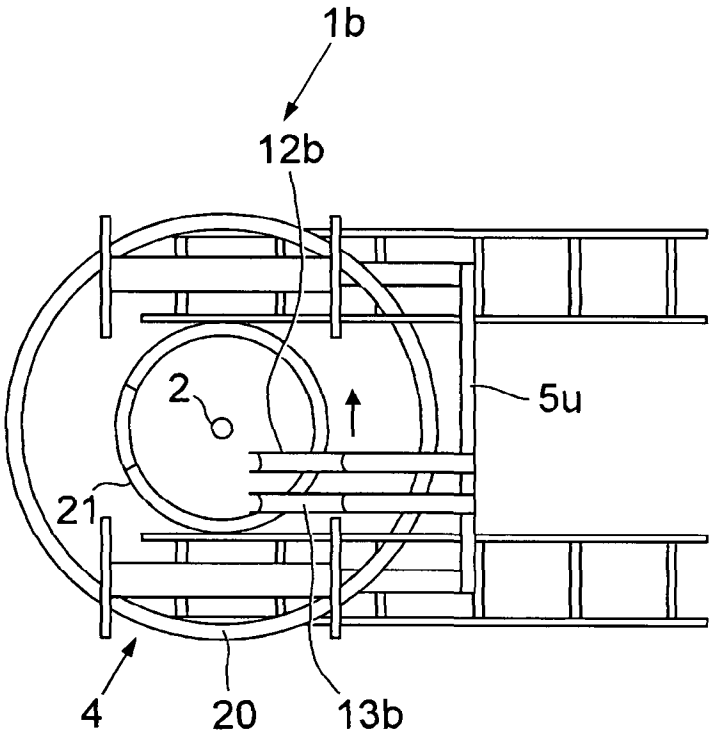

In accordance with a further modification shown in FIGS. 15 and 16, a further embodiment 1*b* is shown which is identical to the previously described embodiments, but has an alternate design of sheaves 12*b*, 13*b* which are mounted on arms that are laterally moveable together along the upper cross bar 5*u* of the vertical portion 5*v*, causing the path taken by the service umbilicals 9, 10 to weave from side to side with respect to the coiled tubing 2, so that a longer length of service umbilical 9, 10 can be paid out in a controlled manner with respect to the deployed length of coiled tubing 2. This ensures that should the coiled tubing 2 stretch under the load of the lubricator 3, there is a certain amount of axial play in the deployed length of service umbilical 9, 10, so that end terminal connections of the service umbilicals do not become disconnected, and so that the service umbilicals themselves do not become tensioned and damaged as a result.

Figure 18:
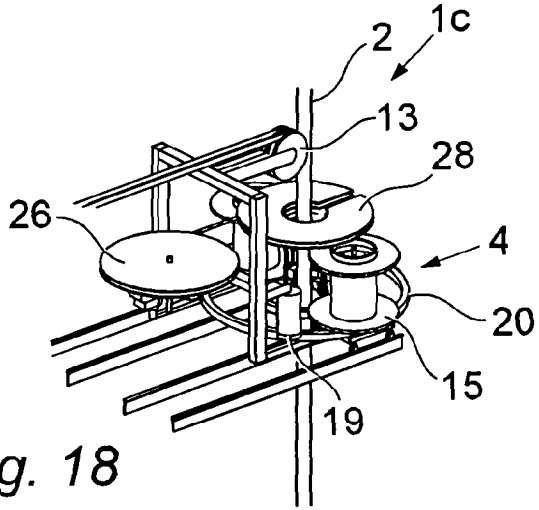
FIGS. 18 and 19 show perspective views of a modification of the first embodiment.
Figure 19:
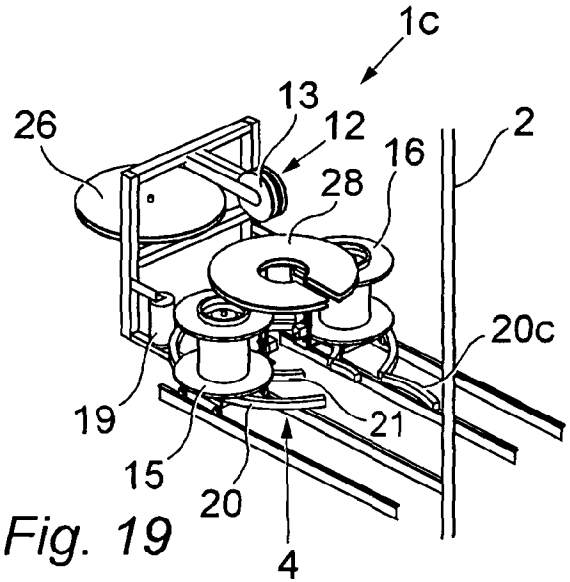

In a further modification shown in FIGS. 18 and 19, the rotating frame 4 is driven in rotation by an external motor 19 attached to the L-shaped frame 5, and engaging the outer surface of the outer ring 20, which can optionally have teeth to mesh with the drive wheel of the motor 19. Optionally the motor can engage the inner surface of one of the rings 20, 21 instead.

Figure 17:
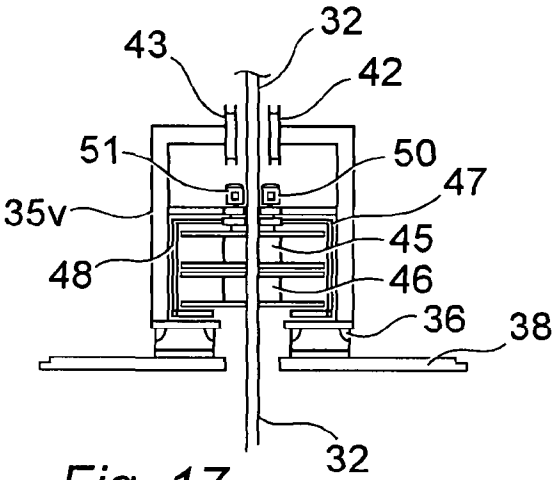
FIG. 17 is a front view of a third embodiment.

Referring now to FIG. 17, a further embodiment 31 is shown having a pair of securing member drums 45, 46 which are stacked with their axes aligned and arranged vertically, and coincident with the axis of the elongate member in the form of the coiled tubing riser 32. Optionally the umbilical drums can be arranged in the same manner, and any reasonable number of drums can be axially stacked on top of one another in this way. The securing member drums 45, 46 (and any other drums in the stack) typically have a radial discontinuity cut in them to allow the riser 32 to move through the radius of the drums 45, 46. The securing tape deployed from the drums 45, 46 is typically pre attached to the drum but in the present embodiment, the drums have typically not completed a revolution to wind any of the tape onto the drum before the drums are moved over the elongate riser 32, so that the wound tapes do not obscure the channels through the radial discontinuities of the drums to allow the drums to be pushed over the elongate member. After the drums are aligned with the elongate member the tape (and umbilical(s)) can be wound onto the drums. One advantage of this method for tape drums is that no slip rings or other designs of rotary couplings are required. A pair of spooling arms 47 and 48 can rotate around the drum to wrap the tape(s) around the elongate member. The spooling arms 47 and 48 are typically driven in rotation around the drums by motor 50. A separate motor 51 typically drives the rotation of the drums 45, 46. Optionally each drum has a spooling arm. Typically the arms can wrap the tape or umbilical onto the elongate member in opposite directions. In most cases only tape drums would be required and the umbilical(s) winches could be positioned clear of the winding mechanism with the umbilical(s) running over sheaves to reach the winding mechanism.

Figure 20:
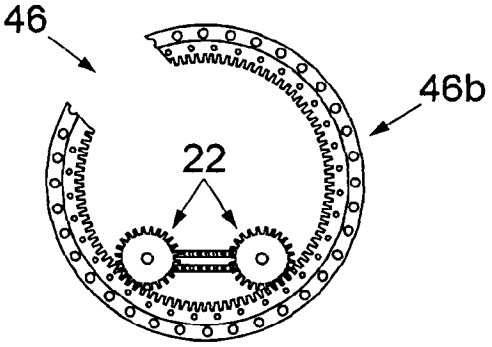
FIG. 20 is plan view of a frame portion of the third embodiment, showing a driving mechanism.

As shown in FIG. 20, the lower drum 46 is typically driven in rotation by a transmission element transmitting torque from a motor (e.g. motor 50). The transmission element typically comprises a pair of cogs 22 mounted on a frame and rotationally connected by a drive chain so that rotation of one forces rotation of the other to the same extent, and having external teeth that mesh with teeth on the inner surface of the barrel 46*b* of the lower drum 46. The lower drum 46 can be rotationally connected to the upper drum 45 so that the two rotate together. The two cogs 22 are typically separated by a distance (e.g. 200 mm) at least as great as the gap formed by the discontinuity 46*c*, so that at least one of the cogs is in contact with the inner surface of the barrel 46*b* at all times. In another embodiment, the cogs 22 can mesh with gears on an outer surface of the drum 46. The principle of the transmission element allowing continuous transmission of torque across the gap of the discontinuity can be applied to any of the embodiments described herein, and can avoid the need to bridge cutaway sections with solid pieces 20*c*, 21*c* etc.

Figure 22:
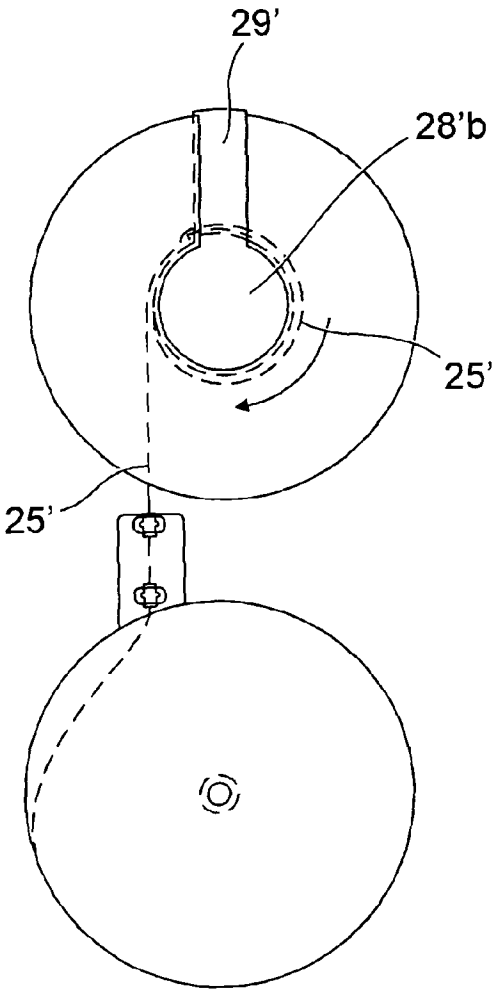
FIGS. 21 & 22 show plan views of alternative power conduit and feeder drums for use in any of the previous embodiments.
Figure 21:
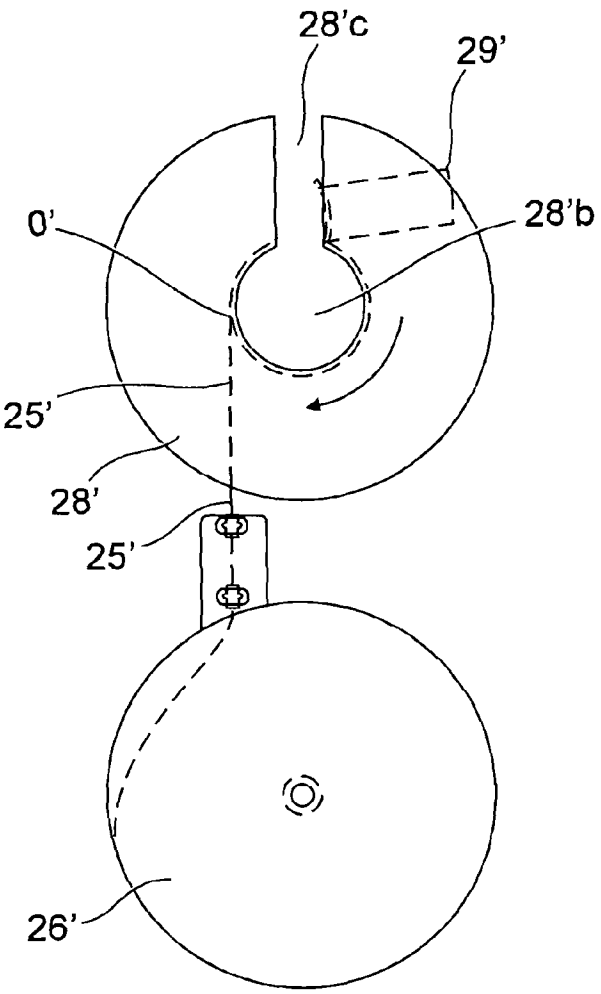

In a further variation shown in FIGS. 21 and 22, the power conduit drum 28' has a discontinuity in the form of a cutaway section 28'*c* which connects a central axial bore 28'*b* of the drum with the exterior of the drum, allowing the coiled tubing 2 to pass through the channel 28'*c* as previously described. The power conduit drum 28' is similar to the drum 28, and receives the power conduit 25' stored on the barrel of a feeder drum 26' as previously described, typically connecting the end of the power conduit to the drum 28' at origin O'. The power conduit drum 28' receives the power conduit 25' by rotating clockwise to spool power conduit 25' from the feeder drum 26' to the power conduit drum 28'. The main difference between the power conduit drum 28' and the earlier described drum 28 is that the channel 28'*c* in the modified drum 28' is closed by a flap 29'. The flap 29' is U-shaped and is hingedly attached at one side of the flap to the barrel of the drum 28' at one side of the channel 28*c*. The flap 29' is shown in the open configuration in FIG. 21, allowing passage of the coiled tubing or other elongate member into the bore 28'*b* of the drum 28'. When the elongate member is safely received in the bore 28'*b*, the drums 28' and 26' are rotated to feed the power conduit 25' from the drum 26' onto the drum 28'. As the flap 29' passes the levelwind device on the feeder drum 26' the power conduit 25' pushes the flap 29' from its open configuration shown in FIG. 21 into its closed configuration shown in FIG. 22, thereby closing the channel 28'*c* in the drum 28' as the first row of power conduit 25' is spooled onto the drum 28'. The radially extending arms of the U-shaped flap 29' close over the gaps in the flanges of the drum 28'. The central web of the flap between the arms of the flap 29' closes over the gap in the barrel of the drum 28'. The web can be formed of a stronger material than the arms. The distance between the arms of the flap 29' can optionally be less than the axial distance between the flanges of the drum 28', so that the flap can move around the hinge freely and can be received between the flanges when in the open position as shown in FIG. 21.

The invention claimed is:

1. Apparatus for use in handling a load, the apparatus comprising;

a load bearing elongate member and a load bearing mechanism for paying out and recovering the load bearing elongate member;

at least one service umbilical and a service umbilical mechanism for paying out and recovering the at least one service umbilical;

at least one securing member to wrap around the load bearing elongate member and each service umbilical, and a wrapping device for rotating the at least one securing member around the load bearing elongate member and the service umbilical as they are being paid out and to unwrap the at least one securing member from the load bearing elongate member and the service umbilical as they are recovered;

wherein the rotation of the at least one securing member by the wrapping device around the load bearing elongate member and each service umbilical is powered by power supplied via a power conduit; and wherein the power conduit is in the form of an elongate flexible conduit that is wrapped onto a power conduit drum that has a central axial bore that is adapted to be arranged generally concentrically with the load bearing elongate member during handling of the load.

2. Apparatus as claimed in claim 1, wherein the power conduit drum has a discontinuity that allows passage of the load bearing elongate member through the discontinuity and into the central axial bore of the power conduit drum.

3. Apparatus as claimed in claim 2, wherein the discontinuity extends an axial length of the power conduit drum.

4. Apparatus as claimed in claim 2, including an insert adapted to close the discontinuity after passage of the elongate member through the discontinuity.

5. Apparatus as claimed in claim 4, wherein the insert is hingedly connected to the power conduit drum.

6. Apparatus as claimed in claim 1, wherein the securing member is stored on a securing member drum, and wherein the wrapping device, the power conduit drum, and the securing member drum are connected to a rotating chassis that rotationally connects these components together.

7. Apparatus as claimed in claim 6, wherein the chassis rotates with respect to the elongate member during operation.

8. Apparatus as claimed in claim 6, wherein the chassis comprises a track that incorporates a radial discontinuity that permits a portion of the track to be removed or moved to allow passage of the elongate member through the discontinuity.

9. Apparatus as claimed in claim 8, wherein the track has a central axial bore, and the radial discontinuity of the track permits radial passage of the elongate member through the track into alignment with the central axial bore.

10. Apparatus as claimed in claim 9, wherein the radial discontinuity of the track is rotationally aligned with the discontinuity of the power conduit drum.

11. Apparatus as claimed in claim 6, wherein the chassis is mounted on rails that guide movement of the power conduit drum and the elongate member in relation to one another.

12. Apparatus as claimed in claim 1, wherein the at least one securing member comprises a resilient material.

13. Apparatus as claimed in claim 1, wherein the at least one securing member is coated with a friction modifier to modify its coefficient of friction.

14. Apparatus as claimed in claim 1, wherein the at least one securing member is flat or in the form of a hollow rope that flattens when in contact with an object.

15. Apparatus as claimed in claim 1, wherein more than one securing member is provided, and wherein the securing members are stored on securing member drums that are set on axes on opposite sides of the elongate member and drum axes are arranged parallel to one another, and perpendicular to the axis of the elongate member.

16. Apparatus as claimed in claim 1, wherein the at least one securing member leaves the wrapping device radially outward of the elongate member to wind the securing member around the outside of both the elongate member and the service umbilical.

17. Apparatus as claimed in claim 1, wherein the at least one securing member is wound around a wrapped bundle of the elongate member and the at least one service umbilical.

18. Apparatus as claimed in claim 1, wherein the at least one securing member is applied to the load bearing elongate member under tension.

19. Apparatus as claimed in claim 1, wherein the securing member is adapted to change its conformation when applied to the load bearing elongate member.

20. Apparatus as claimed in claim 1, wherein the securing member is stored on a securing member drum which has a central aperture through which the securing member passes.

21. Apparatus as claimed in claim 1, wherein the power conduit has one end terminal adapted to connect, and thereby deliver power, to a motor for driving the rotation of the wrapping device for the at least one securing member.

22. Apparatus as claimed in claim 1, wherein the power conduit is fed onto the power conduit drum from a feeder drum that is spaced away from the power conduit drum.

23. Apparatus as claimed in claim 22, wherein the power conduit is wrapped onto the power conduit drum from the feeder drum after the elongate member is in place in the central axial bore of the power conduit drum, and wherein the power conduit is unwrapped from the power conduit drum as the elongate member is paid out.

24. Apparatus as claimed in claim 22, wherein the power conduit is wound from the feeder drum onto the power conduit drum before the elongate member is paid out.

25. Apparatus as claimed in claim 1, wherein the elongate member has a central bore and accommodates at least one line within the central bore.

26. A method for handling a load, the method comprising:

supporting the load from a load bearing elongate member on a load bearing mechanism for paying out and recovering the load bearing elongate member;

providing at least one service umbilical and a service umbilical load bearing mechanism for paying out and recovering the at least one service umbilical and paying out and recovering the service umbilical with the load bearing elongate member;

wrapping at least one securing member around the load bearing elongate member and each service umbilical as they are being paid out and unwrapping the at least one securing member from the load bearing elongate member and the at least one service umbilical as they are recovered; and powering rotation of the securing member by a wrapping device around the load bearing elongate member and each service umbilical by power supplied via an elongate flexible conduit that is wrapped onto a power conduit drum having a central axial bore that is adapted to be arranged generally concentrically with the load bearing elongate member during handling of the load.

27. A method as claimed in claim 26, wherein the load bearing elongate member is passed through a discontinuity of the power conduit drum and into the central axial bore of the power conduit drum.

28. A method as claimed in claim 27, wherein the power conduit is wound onto the power conduit drum to close off the discontinuity in the drum.

29. A method as claimed in claim 26, wherein the securing member is stored on a securing member drum, and wherein the wrapping device, the power conduit drum, and the securing member drum rotate together with respect to the elongate member.

30. A method as claimed in claim 26, wherein the at least one service umbilical is arranged parallel to the elongate member, and is paid out at the same speed and for the same distance.

31. A method as claimed in claim 26, wherein at least one service umbilical is paid out at a faster rate than the elongate member.

32. A method as claimed in claim 31, wherein at least one service umbilical is moved in a cyclic pattern in relation to the elongate member while the two are being paid out, and wherein the at least one service umbilical is secured in place in the cyclic pattern by the wrapping of the securing member around the elongate member and the at least one service umbilical.

33. A method as claimed in claim 26, wherein the power conduit is fed onto the power conduit drum from a feeder drum that is spaced away from the power conduit drum.

34. A method as claimed in claim 33, wherein the power conduit is tensioned while being fed onto the power conduit drum.

35. A method as claimed in claim 33, wherein the power conduit is wrapped onto the power conduit drum from the feeder drum after the elongate member is in place in the central axial bore of the power conduit drum, and wherein the power conduit is unwrapped from the power conduit drum as the elongate member is paid out.

36. A method as claimed in claim 35, wherein tension is applied to the power conduit from a tensioning motor of the feeder drum when the power conduit is wrapped onto the power conduit drum.

37. A method as claimed in claim 35, wherein the power conduit is wound from the feeder drum onto the power conduit drum before the elongate member is paid out.

* * * * *